US005283400A

United States Patent [19]

Leone et al.

[11] Patent Number: 5,283,400

[45] Date of Patent: * Feb. 1, 1994

[54] ELEVATOR SHAFTWAY INTRUSION DEVICE

[75] Inventors: Richard J. Leone; Robert F. Cummins, both of Yonkers; Joseph Vitiello, Riverdale; Thomas Brochhagan, No. Bellmore, all of N.Y.

[73] Assignee: TOC Holding Company of New York, Inc., Bronx, N.Y.

[ * ] Notice: The portion of the term of this patent subsequent to Jun. 25, 2008 has been disclaimed.

[21] Appl. No.: 719,418

[22] Filed: Jun. 24, 1991

Related U.S. Application Data

[63] Continuation-in-part of Ser. No. 462,593, Jan. 9, 1990, Pat. No. 5,025,895.

[51] Int. Cl.[5] ..... G08B 21/00

[52] U.S. Cl. ..... 187/140; 187/105; 187/130

[58] Field of Search ..... 187/105, 100, 105, 130, 187/139, 140

[56] References Cited

U.S. PATENT DOCUMENTS

| | | | |
|---|---|---|---|
| 3,461,422 | 8/1969 | Hansen | 187/140 |
| 4,067,416 | 1/1978 | Lowry | 187/105 |
| 4,092,636 | 5/1978 | Shepard | 340/545 |
| 4,460,066 | 7/1984 | Ohta | 187/105 |
| 4,839,631 | 6/1989 | Tsuji | 340/541 |
| 5,025,895 | 6/1991 | Leone et al. | 187/105 |

*Primary Examiner*—Steven L. Stephan
*Assistant Examiner*—Robert Nappi
*Attorney, Agent, or Firm*—Weil, Gotshal & Manges

[57] ABSTRACT

There is provided an elevator shaftway intrusion detector which utilizes a proximity detector including an energy source for generating a detection field within a zone of detection including the elevator shaft-side roof and floor and a corresponding receiver for receiving the detection field when an object enters the detection zone and thereafter generating a detection signal. A power supply and switching network are employed for applying power from the power supply to the proximity detector and which are responsive to the detection signal for applying power from the power supply to a detection indicator such as a siren.

36 Claims, 3 Drawing Sheets

ELEVATOR SHAFTWAY INTRUSION DEVICE

This application is a continuation-in-part of application Ser. No. 07/462,593 filed Jan. 9, 1990, now U.S. Pat. No. 5,025,295.

This invention relates to intelligent elevator control systems and in particular to an improved intrusion detector for detecting unauthorized entry to the elevator shaftway for use in such systems.

BACKGROUND OF THE INVENTION

As currently designed, intelligent elevator systems incorporate built-in safety precautions to ensure that no injury will be inflicted upon users during the normal operation of the elevator. Such devices include pressure-sensitive elements to determine pressure put on a door while it is closing, optical elements to determine when someone has passed through the elevator doorway, speed tolerance governing and braking devices and the like. Recently, particularly in urban areas having many high-rise structures, people have gained access to the shaft-side roof of the elevator cab through artful and wrongful manipulation of the elevator system. One common form of unauthorized access to elevator car tops is through the placement of strings on the roller release assembly of the elevator door interlock when the elevator is servicing a floor. Once the string is attached to the interlock release assembly, the elevator doors close normally, and the elevator is sent to the next lower floor. When the elevator arrives at the next lower floor, the shoe string is pulled on the floor above allowing the exterior hoistway door to open, which in turn allows access to the top of the elevator car.

While some access to the roof of the elevator car is necessary for the performance of maintenance and repairs on the system, unauthorized entry is extremely dangerous and can easily result in severe injury or death. Thus, a need exists for a device which can detect an unauthorized intrusion and initiate a proper response upon detection. Because of the special nature of the operating environment of an elevator shaft, there exists several problems not readily ascertainable or solvable by the use of a wide variety of detection techniques. For example, the constant vibration of the elevator cab within the shaft would cause severe problems for a reflective optical system because of the misalignment created between source and reflector by the vibrations. Similarly, false detections can easily be made because of the effect on a beam caused by the high volume of dust and particles present in the shaft space. Pressure-sensitive detectors are also not a viable alternative because of the extreme pressure changes which occur in the shaft as the elevator cab moves within it. Further, these systems do not lend themselves to servicing nor do they permit the elevator system to return to normal operation when an intruding object is removed. A need exists, therefore, for a reliable detection device which can be easily installed and maintained, and which can accurately detect the entry onto an elevator cab roof without giving false warnings.

It is an object of the present invention to provide a reliable intrusion detection system for use on the shaft-side roof of an elevator cab.

It is a further object of the present invention to provide an intrusion detection system for use on the shaft-side roof of an elevator cab which can detect an unauthorized entry onto the roof and produce an appropriate response.

It is a further object of the present invention to provide an intrusion detection system for use on the shaft-side roof of an elevator cab which will not produce false indications of an intrusion based on the operating environment of the elevator shaft and which will allow the elevator system to be easily serviced and will allow it to return to normal operation if an object intrudes upon the cab roof and is immediately thereafter removed from the cab roof.

It is a still further object of this invention to employ a proximity detection system in conjunction with a switching network to detect unauthorized entry onto a elevator cab roof on the shaft-side of the cab.

SUMMARY OF THE INVENTION

These and other objects of the invention are achieved in accordance with the present invention by the use of proximity detection means including an energy source for generating a detection field within a zone of detection including the elevator shaft-side roof and floor and corresponding receiver means for receiving the detection field when an object enters the detection zone and thereafter generating a detection signal, power supply means and switching network means for applying power from the power supply means to the proximity detection means and being responsive to the detection signal for applying power from the power supply means to detection indication means. In a preferred embodiment of the invention, the detection signal is latched for a period of time and also sent to an external elevator safety system and also operates to energize an audible siren.

DETAILED DESCRIPTION OF THE PREFERRED EMBODIMENT

Figure 1:
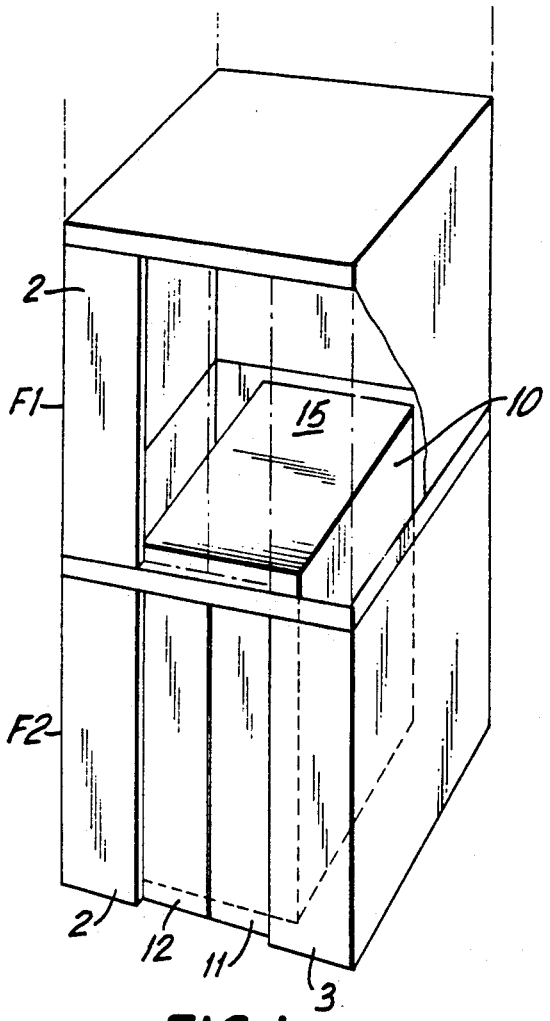
FIG. 1 is pictorial representation showing two floors of an elevator system.

In FIG. 1, an elevator shaft 1 is shown in section along two floors F1 and F2. Each floor has a set of hoistway doors 2, 3 which block entry to the elevator shaft when the elevator car is not servicing that floor and allow entry to the car when it is servicing the floor. In FIG. 1, the elevator car 10 is shown in phantom line servicing floor F2. The elevator car doors 11, 12 are shown closed on floor F2. On floor F1, the hoistway door 2 is retracted and door 3 is not shown. As shown, when the hoistway doors 2, 3 on floor F1 are manipulated to remain open when the elevator is servicing floor F2, the shaft-side roof 15 of elevator car 10 is visible and accessible from floor F1 through the shaft opening created by the retracted hoistway doors 2, 3 on floor F1.

Figure 2:
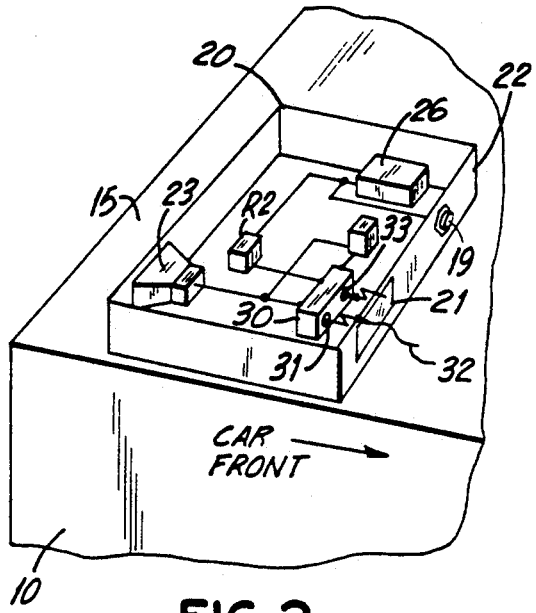
FIG. 2 is a pictorial representation showing the present invention disposed in a housing and mounted on the shaft-side roof of an elevator car.

FIG. 2 is a pictorial representation of the present invention disposed in a housing 20 mounted on the shaft-side roof 15 of elevator car 10. The arrangement of FIG. 2 is shown schematically in FIG. 3.

A proximity detection unit 30 is mounted in the housing such that it aligns with a beam aperture 21 formed in a lateral side 22 of the housing 20. Proximity detection unit 30 contains a modulated light emitting diode 31 which generates a detection beam 32 inside the elevator shaft proximate the location of the elevator car roof 15. Proximity detection unit 30 also includes a photodetector cell 33 designed to receive and detect a diffusion of the beam 32 if and when an object enters the path of the emitted detection beam 32. A commercially available and acceptable device for unit 30 is an Allen Bradley Type 42MR Photodetector.

Figure 3:
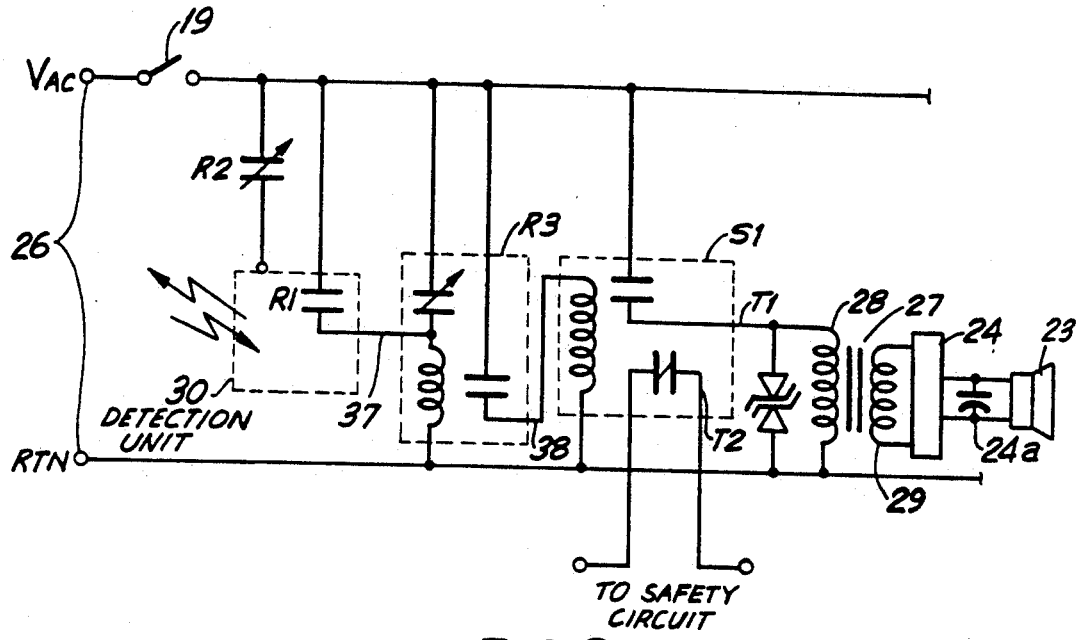
FIG. 3 is a schematic representation of the system of FIG. 2 with no power applied.

As shown in FIG. 3, the proximity detection unit 30 receives primary power from a power supply unit 26 and is electrically connected to an in-line delay-on-make timer relay R2. The power supply unit can be replaced by tapping the main line of the elevator system. The proximity detection unit 30 has an internal switching system R1 which is described in greater detail hereinbelow.

Figure 2A:
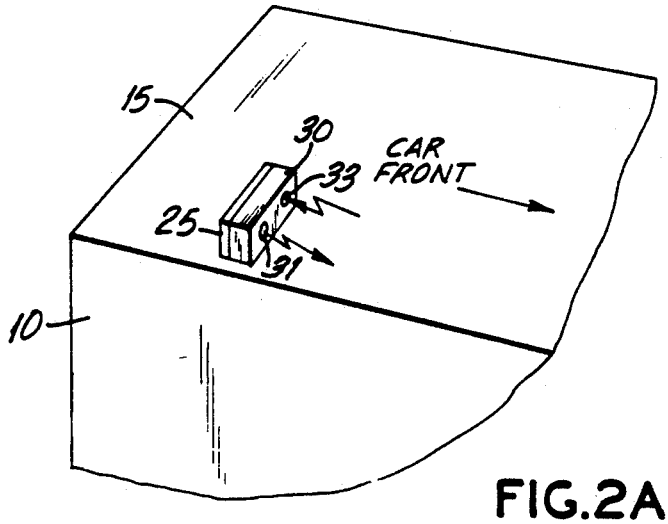
FIG. 2A is an alternative embodiment of the present invention; .

The output 37 of internal system R1 is in turn in electrical connection with an in-line delay-on-break timer relay R3 which acts to latch a signal presented at its input by relay R1. The output 38 of relay R3 is electrically connected to a four-pole switching network S1. One side of the primary tap 28 of step-down transformer 27 is electrically tied to the switch S1 at terminal T1. Switch S1 also has a pair of normally closed contacts T2 electrically connected in series with other safety devices and ultimately to an external elevator safety circuit. Typically, transformer 27 will step down the available 110VAC line to 12 volts. The secondary tap 29 of transformer 27 drives an audible warning indicator siren 23 across a rectifier circuit 24 and filter capacitor 24*a*. It will be appreciated by those of ordinary skill in the art that relays R2 and R3, switching network S1 and the associated control signals produced in accordance with the delay-on-make and delay-on-break functions can be replaced by an electronic circuit including, respectively, appropriate power MOSFET's (metal oxide semiconductor field effect transistors) or bipolar transistors, an appropriate power transistor amplifier to drive the audible warning indicator, and appropriate control circuitry. In this case, the housing 20 may be replaced by a printed circuit board 25 as shown in FIG. 2*a*.

Figure 4:
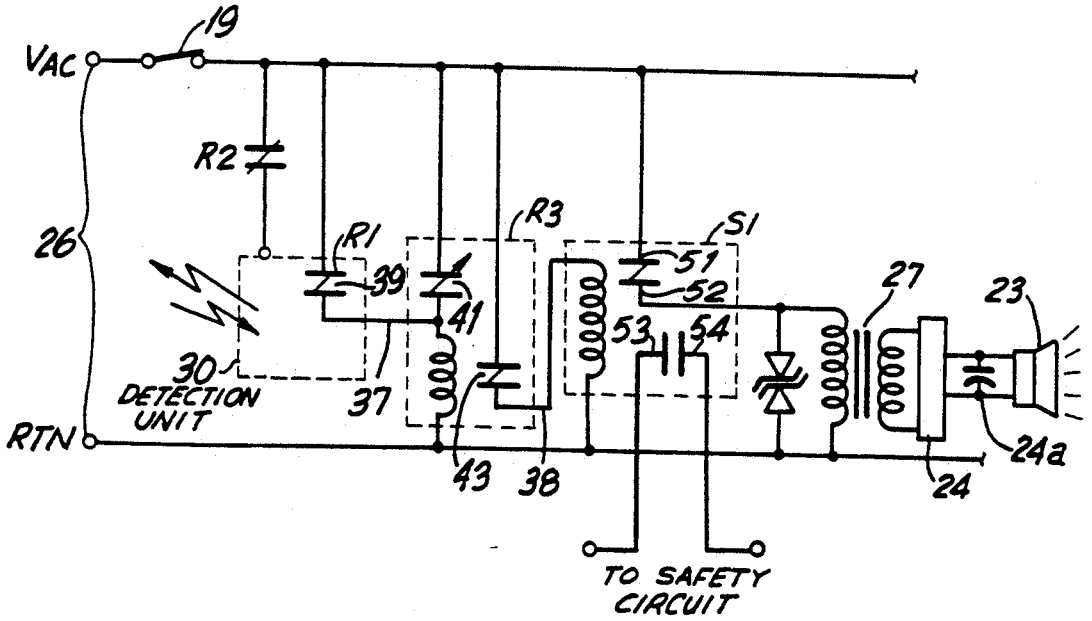
FIG. 4 is a schematic representation of the system of FIG. 2 with power applied.

The schematic diagram shown in FIG. 3 represents a condition in which no power has yet been applied to the system. With reference to FIG. 4 the operation of the present invention is described when it is armed and an object, such as a person, has entered upon the shaft-side roof of the elevator cab. The system is initially armed by turning key-switch 19 to the on position. In-line delay-on-make timer relay R2 closes its contacts a certain elapsed time after key-switch 19 is turned to the position. This allows the operator sufficient time to arm the system and exit the elevator cab roof without setting off the alarm. Power is supplied through timer relay R2 to the photohead circuit of detection unit 30. When photohead 33 detects the diffusion of beam 32 from the object in the detection zone, contacts 39 of internal, switching system Ri are closed, thereby energizing the coil of latching relay R3. The operation of latching relay R3 is such that even if the object leaves the detection zone, thereby opening relay contacts 39, the delay-on-break function will keep contacts 41 of relay R3 closed for a predetermined amount of time. This has the effect of keeping the coil of relay R3 energized and the detection signal latched at relay R3 for a predetermined amount of time. Once relay R3 is energized, the contacts 43 will close to provide power to and energize the coil of switch S1, which has normally open contacts 51 and 52 and normally closed contacts 53 and 54. The normally open contacts 51 and 52 close upon energization of the switch coil and act to supply power to transformer 27, thereby activating siren 23. Normally closed contacts 53 and 54 are connected in series with other safety devices of the elevator safety circuit. Upon energization of the switch coil, contacts 53 and 54 create an open circuit in the safety circuit which causes the elevator to cease operation and carry out functions in accordance with the predetermined algorithmic scheme of the safety circuit. If the object leaves the detection zone, as stated above, the siren 23 will produce a warning signal for a period of time equal to the latching period of relay R3 and, thereafter, control of the elevator will return to the normal operating system. If the object remains in the detection zone, the audible warning signal and open safety circuit will be continuously produced. Alternatively, the system may be designed to discontinue elevator service when an object has entered and subsequently been removed from the roof of the elevator car by always keeping the safety circuit open. This may be accomplished by simply omitting the in-series connection of normally closed terminals 53 and 54 of switch S1 and replacing it with a switching mechanism which is adapted to open and remain open each and every time an intrusion is detected.

Although the embodiment of the invention described herein is described for use on the shaft-side roof of an elevator car, it can similiarly be used to detect intrusion of the elevator shaft in the area below the elevator by simply mounting a unit on the shaft-side floor of the elevator car.

Other forms of energy may also be used to carry out the functions of detection unit 30. For example, sound or micro wave transmitters and receivers could be used in place of the optical-based units described above. A commercially available acoustic based unit which can be used in the circuit of FIG. 3 in place of detection unit 30 is the Massa M-4000 system described in *Sensors*, Vol. 6, No. 11, November, 1989.

Figure 5:
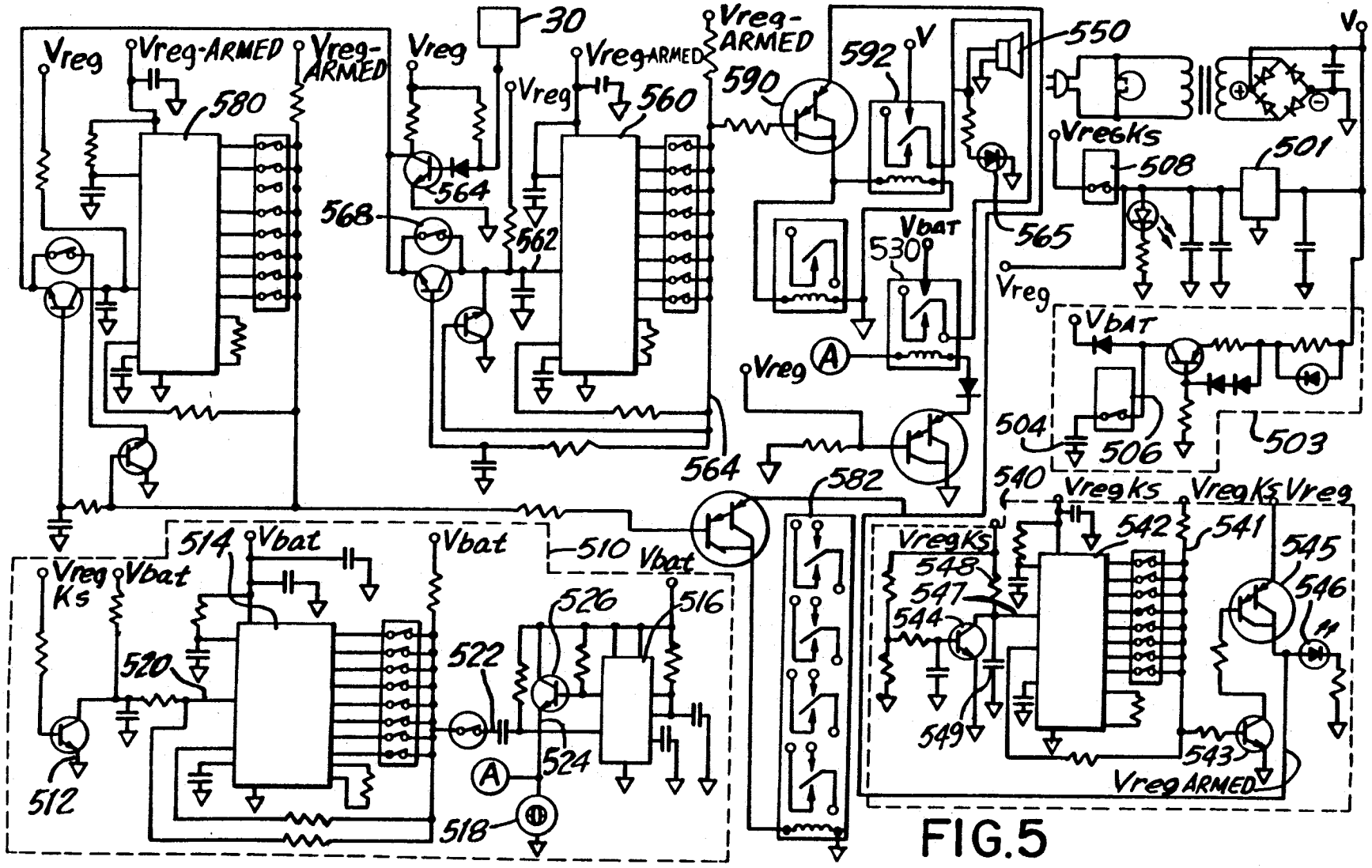
FIG. 5 is a schematic of an alternative circuit for implementing the present invention

FIG. 5 shows a second circuit configuration Which includes features in addition to those shown in the circuit of FIG. 3. Referring to FIG. 5, an AC voltage source is applied through a step-down transformer to an 8-volt DC regulator 501 and to a battery backup circuit generally labelled as 503. The regulated DC Voltage Vreg is applied to various inputs of the circuit of FIG. 5, as is described below, and is also selectively supplied to other circuit inputs as Vregks through an arming key switch 508. When voltage V is present, a battery 504 is charged through the conventional charge circuit 503. A voltage Vbat from battery 504 is selectively supplied to a chirping circuit 510 through a battery disable key switch 506.

Chirping circuit 510 includes a transitor 512, a chirp timer 514, a one-shot pulse generator 516 and a piezeoelectric transducer 518. The operation and circuit connections of these elements are well known to users of these conventional devices. In operation, when the backup chirping circuit is enabled by virtue of key switch 506 being closed, power is supplied to the chirp timer 514, and the one-shot 516 by way of voltage Vbat. If voltage Vreg is present, transitor 512 is turned on and the trigger input 520 of chirp timer 514 is held low. Since no transistions occur on the trigger input 520 while Vreg is present, no sound is produced by transducer 518. Once Vreg is removed, transistor 512 turns off, causing a transition on input 520. Once triggered, the timer will produce a periodic output signal on output 522 based on the configuration of the output control signals of the chirp timer 514. Transistions in the output signal 522 in turn cause one-shot 516 to trigger, producing a periodic pulse at output 524, thereby turning transistor 526 on and off. This results is an audible output from piezoelectric transducer 518. Thus, transducer 518 chirps because it will be audible only during the duration of the pulse on output 524, which is produced once every cycle of the output signal 522.

The output 524 is also supplied to one end of the coil of a relay 530 to energize it during the audible period of transducer 518. Once energized, relay 530 supplies voltage Vbat to siren 550 causing it to sound during the same period that transducer 518 is audible.

If key switch 506 is an open position, voltage Vbat is not supplied to circuit 510 or relay 530 and no sound is produced if voltage Vreg is removed.

When arming key switch is closed to activate the system, Vregks is applied to turn-on delay circuit 540 which includes a conventional timer 542, transistors 544 and 545 and light-emitting diode 546. Vregks is applied immediately to timer 542 to power it up and also to the output 541 of timer 542 through a pull up resistor to ensure that the output 541 remains high. Vregks is also applied to the trigger input 547 of timer 542, which is connected to the collector of transistor 544, and to the base of transistor 544 through respective RC networks. Thus, input 547 is pulled high after the RC time constant determined by resistor 548 and capacitor 549. This transistion causes timer 542 to trigger. The time constant associated with the RC network connected to the base of transistor 544 is longer than the RC time constant of components 548 and 549. Thus, some time after the transistion on input 547 from low to high, transistor 544 will turn on, thereby clamping input 547 to ground. This ensures that there will be no further transitions on input 547.

Once triggered, the timer 542 will produce a low output pulse on output line 541 for a duration determined by the configuration of the output control signals of the timer 542. During the period when output 541 is held low, NPN transistor 543 is off, which turns PNP transistor 545 off. The emitter of PNP transistor 545 is connected to Vreg. Since transistor 545 is off during the period when output 541 is low, voltage Vreg is not supplied to siren-on timer 560, auxiliary timer 580, or transistor 590. This ensures that no warning will be produced by siren 550 during the period when output 541 is low, which is adjusted to allow an operator sufficient time to arm the system by turning on key switch 508 and to exit the area of the top of the elevator car.

Once output 541 goes high after the pre-determined turn-on period, transistor 543 turns on, which in turn causes transistor 545 to turn on, producing a voltage Vreg-armed at the output of transistor 545. This voltage, Vreg-armed is then supplied to power up siren-on timer 560 and auxiliary timer 580. It is also supplied to the emitter of transistor 590. The system is now armed for operation. LED 546 also turns on to indicate the unit is armed.

The output of unit 30 is an open-collector NPN transistor (not shown) whose emitter is connected to ground. During operation, if no object enters the zone of detection of unit 30, its open-collector output remains high. Since the base of transistor 564 is being pulled high by voltage Vreg and the open-collector output of sensor 30 is high, transistor 564 remains on and the trigger input 562 of timer 560 is clamped to ground through infinity switch 568. In this state, output 564 of timer 560 remains high and transistor 590 is off. Thus, no voltage is applied to the coil of relay 592 or to siren 550.

When detection unit 30 is triggered, its open collector output goes low, turning off transistor 564 and thereby creating a low to high transistion on input 562 which causes siren-on timer 560 to trigger. As with timers 514 and 542, the output 564 of timer 560 will go low for a period determined by the configuration of the output control signals of timer 560, which will turn on transistor 590. This in turn supplies voltage to the coil of relay 592 to energize it. Once energized, the contacts of relay 592 supply voltage to siren 550 and an alarm LED 565.

The siren 550 will operate as long as the output 564 of timer 560 is low. Thus, even though the intruding object which caused the proximity sensor 30 to trigger is removed, thereby turning on transistor 564 and clamping input 562 to ground, the siren will continue to operate for the predetermined period set by the configuration of the output control signals of timer 560.

The operation of auxiliary timer 580 is identical to that of timer 560. The output of timer 580 is used to drive an auxiliary relay 582. This relay 582 can be used to indicate an alarm condition to a number of other elevator system inputs such as a fire alarm, external elevator safety circuit or a monitoring station.

The detailed description of the preferred embodiment having been set forth herein, it is known that there can be departure therefrom without departing from the true scope and spirit of the invention as claimed herein.

We claim:

1. A detection system for detecting intrusion into an elevator shaft having an elevator cab therein and a plurality of elevator shaft access ways in at least one wall of said shaft comprising:

an intrusion detector mounted at a location within the shaft above the elevator cab for monitoring an energy field in a zone of detection including at least a portion of the elevator shaft proximate the top of said cab and for providing a detection signal representing a disturbance in said energy field caused by an intruder in the shaft, entering said zone of detection.

2. The detection system according to claim 1 wherein said intrusion detector further comprises source means for generating said energy field in said zone of detection.

3. The detection system according to claims 1 or 2 wherein said energy field is an electromagnetic field.

4. The detection system according to claims 1 or 2 wherein said energy field is a sonic field.

5. The detection system according to claim 3 wherein said electromagnetic field comprises electromagnetic energy in the infrared frequency band.

6. The detection system according to claim 3 wherein said electromagnetic field comprises electromagnetic energy in the radio frequency band.

7. The detection system according to claim 3 wherein said electromagnetic field comprises electromagnetic energy in the microwave frequency band.

8. The detection system according to claim 4 wherein said sonic field comprises sonic energy in the ultrasonic frequency band.

9. The detection system according to claims 1 or 2 further comprising a power supply for supplying power to said system and a detection indicator responsive to said detection signal for indicating said intrusion.

10. A detection system for detecting intrusion into an elevator shaft having an elevator cab therein and a plurality of elevator shaft access ways in at least one wall of said shaft comprising:

an intrusion detector mounted at a location within the shaft above the elevator cab for monitoring an energy field in a zone of detection including at least a portion of the elevator shaft proximate the top of said cab and said wall of said shaft and for providing a detection signal representing a disturbance in said energy field caused by an intruder in the shaft, entering said zone of detection.

11. The detection system according to claim 10 wherein said intrusion detector further comprises source means for generating said energy field in said zone of detection.

12. The detection system according to claims 10 and 11 wherein said energy field is a electromagnetic field.

13. The detection system according to claims 10 and 11 wherein said energy field is a sonic field.

14. The detection system according to claim 12 wherein said electromagnetic field comprises electromagnetic energy in the infrared frequency band.

15. The detection system according to claim 12 wherein said electromagnetic field comprises electromagnetic energy in the radio frequency band.

16. The detection system according to claim 12 wherein said electromagnetic field comprises electromagnetic energy in the microwave frequency band.

17. The detection system according to claim 13 wherein said sonic field comprises sonic energy in the ultrasonic frequency band.

18. The detection system according to claims 10 or 11 further comprising a power supply for supplying power to said system and a detection indicator responsive to said detection signal for indicating said intrusion.

19. A detection system for detecting intrusion into an elevator shaft having an elevator cab therein and a plurality of elevator shaft access ways in at least one wall of said shaft comprising:

an intrusion detector mounted at a location within the shaft below the elevator cab for monitoring an energy field in a zone of detection including at least a portion of the elevator shaft proximate the bottom of said cab and for providing a detection signal representing a disturbance in said energy field caused by an intruder in the shaft, entering said zone of detection.

20. The detection system according to claim 19 wherein said intrusion detector further comprises source means for generating said energy field in said zone of detection.

21. The detection system according to claims 19 or 20 wherein said energy field is an electromagnetic field.

22. The detection system according to claims 19 or 20 wherein said energy field is a sonic field.

23. The detection system according to claim 21 wherein said electromagnetic field comprises electromagnetic energy in the infrared frequency band.

24. The detection system according to claim 21 wherein said electromagnetic field comprises electromagnetic energy in the radio frequency band.

25. The detection system according to claim 21 wherein said electromagnetic field comprises electromagnetic energy in the microwave frequency band.

26. The detection system according to claim 22 wherein said sonic field comprises sonic energy in the ultrasonic frequency band.

27. The detection system according to claims 19 or 20 further comprising a power supply for supplying power to said system and a detection indicator responsive to said detection signal for indicating said intrusion.

28. A detection system for detecting intrusion into an elevator shaft having an elevator cab therein and a plurality of elevator shaft access ways in at least one wall of said shaft comprising:

an intrusion detector mounted at a location within the shaft below the elevator cab for monitoring an energy field in a zone of detection including at least a portion of the elevator shaft proximate the bottom of said cab and said wall of said shaft and for providing a detection signal representing a disturbance in said energy field caused by an intruder in the shaft, entering said zone of detection.

29. The detection system according to claim 28 wherein said intrusion detector further comprises source means for generating said energy field in said zone of detection.

30. The detection system according to claims 28 or 29 wherein said energy field is an electromagnetic field.

31. The detection system according to claims 28 or 29 wherein said energy field is a sonic field.

32. The detection system according to claim 30 wherein said electromagnetic field comprises electromagnetic energy in the infrared frequency band.

33. The detection system according to claim 31 wherein said electromagnetic field comprises electromagnetic energy in the radio frequency band.

34. The detection system according to claim 30 wherein said electromagnetic field comprises electromagnetic energy in the microwave frequency band.

35. The detection system according to claim 31 wherein said sonic field comprises sonic energy in the ultrasonic frequency band.

36. The detection system according to claims 28 or 29 further comprising a power supply for supplying power to said system and a detection indicator responsive to said detection signal for indicating said intrusion.

* * * * *